US010551088B2

(12) United States Patent
Cothren et al.

(10) Patent No.: US 10,551,088 B2
(45) Date of Patent: Feb. 4, 2020

(54) OUTDOOR HEATING OR COOLING SYSTEM CREATING AN OPEN TEMPERATURE-CONTROLLED ZONE

(71) Applicants: Brian Cothren, Fleming Island, FL (US); William Quillen, Jacksonville, FL (US)

(72) Inventors: Brian Cothren, Fleming Island, FL (US); William Quillen, Jacksonville, FL (US)

(73) Assignee: ATHLETIC RECOVERY ZONE, LLC, Jacksonville, FL (US)

( * ) Notice: Subject to any disclaimer, the term of this patent is extended or adjusted under 35 U.S.C. 154(b) by 1034 days.

(21) Appl. No.: 14/465,562

(22) Filed: Aug. 21, 2014

(65) Prior Publication Data

US 2014/0360697 A1 Dec. 11, 2014

Related U.S. Application Data

(63) Continuation-in-part of application No. 13/398,962, filed on Feb. 17, 2012, now Pat. No. 9,435,554.

(51) Int. Cl.

| | |
|---|---|
| ***F24F 5/00*** | (2006.01) |
| ***F24F 3/02*** | (2006.01) |
| ***F24H 3/02*** | (2006.01) |
| ***F24F 3/16*** | (2006.01) |

(52) U.S. Cl.

CPC ..... *F24H 3/02* (2013.01); *F24F 3/1607* (2013.01); *F24F 5/001* (2013.01); *F24F 5/0096* (2013.01); *F24F 2221/18* (2013.01)

(58) Field of Classification Search

CPC ..... F24F 2221/12; F24F 2221/125; F24F 2221/18; F24F 5/0096; F24F 17/08; F24F 2221/10; F24F 3/1607; F24F 5/001; F25D 17/06; F24H 3/02

USPC ..... 62/261, 426, 427, 237, 428, 448, 411, 62/259.1, 263; 297/180, 428, 180.13; 165/48.1; 454/241, 245, 246

See application file for complete search history.

(56) References Cited

U.S. PATENT DOCUMENTS

| | | | | |
|---|---|---|---|---|
| 2,251,706 A * | 8/1941 | Loewy | B44F 9/00 62/331 |
| 2,782,834 A | 2/1957 | Vigo | |
| 3,097,505 A * | 7/1963 | Smith | F24F 1/02 297/180.14 |
| 3,745,305 A * | 7/1973 | Reed | A61F 7/02 219/217 |
| 3,818,892 A | 6/1974 | Von Kohorn | |
| 3,875,996 A | 4/1975 | Von Kohorn et al. | |
| 3,948,246 A * | 4/1976 | Jenkins | A61F 7/0085 126/204 |
| 4,134,615 A * | 1/1979 | Jenkins | A47C 7/748 297/180.13 |

(Continued)

*Primary Examiner* — Cassey D Bauer
*Assistant Examiner* — Kristin U Oswald
(74) *Attorney, Agent, or Firm* — Thomas C. Saitta

(57) ABSTRACT

A cooling or heating system creating an open temperature-controlled zone for personnel, the system having HVAC equipment for producing and delivering cooled or heated air, a lower air outlet disposed in a deck member, an upper air outlet disposed in a wall member, and a central air intake disposed between the lower and upper air outlets, whereby conditioned air expelled from the lower and upper air outlets is recycled through the central air intake and HVAC equipment.

11 Claims, 4 Drawing Sheets

(56) References Cited

U.S. PATENT DOCUMENTS

| | | | | | |
|---|---|---|---|---|---|
| 4,272,966 | A * | 6/1981 | Niemann | F25D 1/00 | 165/253 |
| 4,307,701 | A | 12/1981 | Balon et al. | | |
| 4,775,001 | A * | 10/1988 | Ward | F24F 3/00 | 165/108 |
| 4,981,324 | A * | 1/1991 | Law | A47C 7/74 | 297/180.11 |
| 5,062,424 | A * | 11/1991 | Hooker | A41D 13/0053 | 128/897 |
| 5,596,836 | A | 1/1997 | Benson | | |
| 6,318,113 | B1 * | 11/2001 | Levy | F24F 3/044 | 454/306 |
| 6,435,608 | B1 | 8/2002 | Floyd, Jr. | | |
| 6,580,060 | B1 | 6/2003 | Inman et al. | | |
| 6,776,453 | B1 | 8/2004 | Floyd, Jr. | | |
| 6,863,342 | B2 | 3/2005 | Floyd, Jr. | | |
| 7,234,318 | B2 * | 6/2007 | Grisler | F24F 3/1405 | 62/408 |
| 2002/0175541 | A1 * | 11/2002 | Floyd, Jr. | A47C 7/744 | 297/180.12 |
| 2005/0250436 | A1 | 11/2005 | Nilsson | | |
| 2006/0162368 | A1 * | 7/2006 | Boland | A45B 3/00 | 62/310 |
| 2008/0250800 | A1 * | 10/2008 | Wetzel | F24F 1/022 | 62/179 |
| 2011/0100592 | A1 * | 5/2011 | Johnson | F24F 1/04 | 165/58 |

* cited by examiner

OUTDOOR HEATING OR COOLING SYSTEM CREATING AN OPEN TEMPERATURE-CONTROLLED ZONE

This application is a continuation-in-part application of U.S. Non-Provisional patent application Ser. No. 13/398,962, filed Feb. 17, 2012, the disclosure of which is incorporated herein by reference.

BACKGROUND

This invention relates generally to the field of devices used to provide localized cooling or heating in an outdoor setting, and more particularly to such devices capable of cooling or heating personnel, such as athletes standing or sitting on the sidelines of sporting events, firefighters at the scene of a fire, workers in high or low temperature environments, participants in long running races, etc., and more particularly relates to such devices that provide cool or warm air in a substantially open, temperature-controlled zone accessible by the personnel.

Sporting events such as football, soccer, tract, etc., occurring outdoors are subject to weather conditions of extreme high or low temperatures. The athletes in these events, particularly when standing or sitting on the sidelines before, during or after a contest, can become overheated or badly chilled. Likewise, workers toiling outdoors under extreme temperature conditions, in particular when heavy safety or protective gear must be worn, are susceptible to overheating or hyperthermia.

It is an object of this invention to provide a closed loop system for supplying cooled or heated air to a localized outdoor zone in a controlled manner such that personnel may enter the temperature-controlled zone to be warmed or cooled, wherein the temperature-controlled zone is not a fully enclosed environment but is substantially open, and wherein the majority of air conditioned by the air conditioning equipment is retrieved from the temperature-controlled zone, i.e., the previously conditioned air is recycled into the air conditioning equipment to be re-cooled or re-heated. It is another object to provide such a system that is transportable such that the system can be brought to any location where a controlled heating or cooling zone is required.

SUMMARY

In one embodiment the outdoor heating and cooling system is a seating system and generally comprises a bench device having a seat member adapted for seating one or more personnel, a seat back member or wall member, a deck member adapted to support personnel standing thereon, and a cabinet. The air flow of the system is controlled by an apparatus comprising a first or lower air outlet, a second or upper air outlet, a first or central air intake disposed within the interior of the temperature-controlled zone, and a high volume air conditioning (HVAC) apparatus or means for conditioning air by producing heating or cooling temperature change to air. The lower air outlet, upper air outlet and central air intake may each comprise single openings of large and/or longitudinally extended scope, typically covered with a grate or other apertured member, or may each comprise a combination of distinct multiple openings, again typically covered by a grate or other apertured member.

In one general embodiment of the system, the lower air outlet is positioned on the deck member, and the upper air outlet is disposed above the seat member. The central air intake is located in the seat back member or wall member above the seat member. The HVAC apparatus is connected to the lower air outlet and the upper air outlet by one or more air delivery conduits, and the central air intake can be connected to the HVAC apparatus by an air return conduit.

The HVAC apparatus forces conditioned air through the air delivery conduits to the lower air outlet, where it is expelled generally vertically, and the upper air outlet, where it is expelled generally horizontally or downwardly. The central air intake is disposed between the lower and upper air outlets so as to reside in the interior of the temperature-controlled zone. In this manner the conditioned air expelled by the air outlets of the system is recycled by the air intake to create a closed loop, temperature-controlled zone within a substantially open area. Once the user enters the zone, heat is exchanged between the user and the charged air (i.e., heated or cooled air), depleting the temperature charge of the air. Air having a depleted charge is then retrieved from the temperature-controlled zone via the central air intake and passed through the air return conduit and returned to the intake of the HVAC apparatus. This recycled air is then reconditioned by the HVAC apparatus and once again delivered to the lower air outlet and the upper air outlet via the air delivery conduits, thereby lowering the energy costs to condition the air as opposed to continually conditioning ambient air.

In another embodiment, the system further comprises a second air intake disposed below the seat member and above the deck member, and operably connected to the air return conduits. The second air intake may further comprise a damper that is manipulated to control the flow of air through the second air intake. When the damper opens, air also reenters the system via the second air intake, whereby the air trapped below the seat member is returned to the HVAC apparatus via the return conduits.

Another embodiment of the system further comprises transportation means for transporting the system, such as a motorized vehicle or wheeled trailer, such that the system can be taken to any outdoor location where a temperature-controlled zone is desired.

In still another embodiment of the temperature-controlled zone outdoor heating or cooling system, the system comprises in general a deck member structured and adapted to support personnel standing, portable chairs, portable benches, operating gurneys, etc. thereon, and a wall member, the wall member being generally vertically oriented. The air flow of the system is controlled by a combination of elements comprising a lower air outlet, an upper air outlet, a central air intake disposed within the interior of the temperature-controlled zone, and a high volume air conditioning (HVAC) apparatus or means for conditioning air by producing heating or cooling temperature charge to air. The lower air outlet, upper air outlet and central air intake may each comprise single openings of large and/or longitudinally extended scope, typically covered with a grate or other apertured member, or may each comprise a combination of distinct multiple openings, again typically covered by a grate or other apertured member. The lower air outlet is disposed in the deck member whereby conditioned or treated air is expelled upwardly from the deck member and the upper air outlet is disposed at, adjacent or near the top of the wall member whereby conditioned or treated air is expelled generally horizontally or downwardly across or toward the deck member. The wall member may form a portion of a cabinet. The central air intake is positioned in the wall member at a height between the deck member and the top of the wall member, and is positioned interiorly relative to the sides of the wall member. In this manner, a major portion of the conditioned air expelled from the first and upper air outlets is drawn into the central air intake and recycled through the HVAC apparatus prior to be redelivered into the substantially open, temperature-controlled zone.

DETAILED DESCRIPTION

Figure 1:
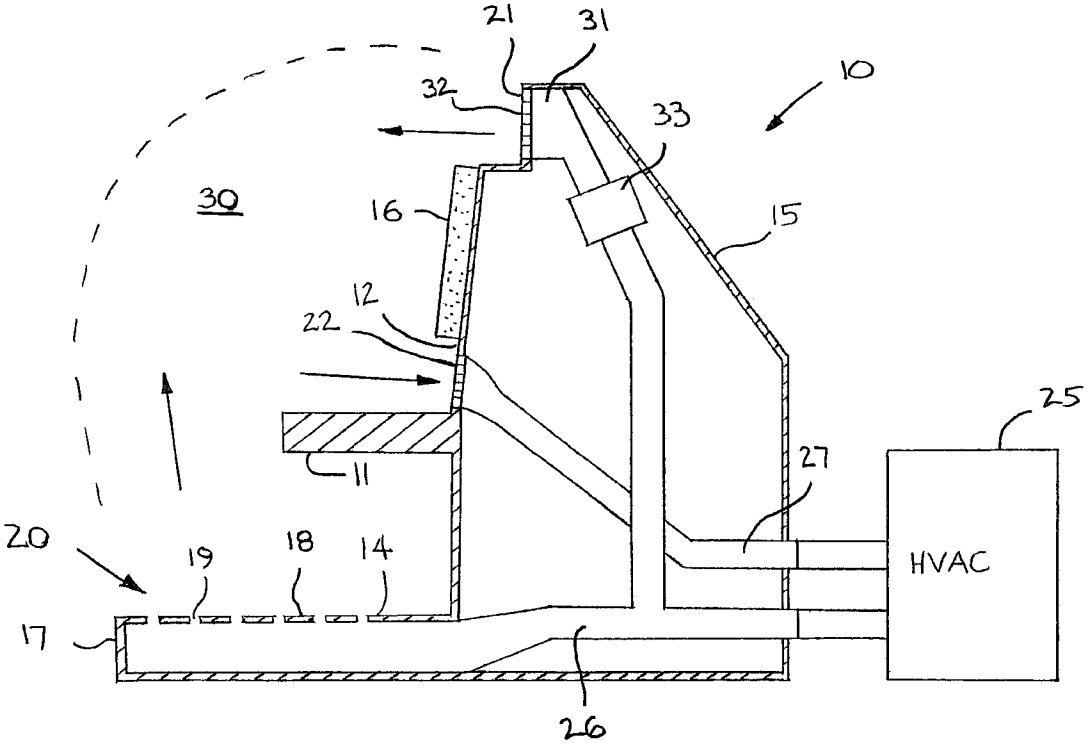
FIG. 1 is a cross sectional view of a basic embodiment of the system including a seat member.

Referring to the figures, various embodiments of an exemplary outdoor heating or cooling system, and components thereof, are described and shown. Certain embodiments possess integral seating structures, while other embodiments do not. The embodiments disclosed herein are meant for illustration and not limitation of the system. An ordinary practitioner will understand that it is possible to create other variations of the following embodiments without undue experimentation.

In this disclosure the term "open" or "substantially open" is used to define the temperature-controlled zone created by the system. The terms as used herein define a three-dimensional zone that is completely or substantially unbounded or unblocked by solid walls or similar structures on the front, ends and top of the zone. The rear of the zone and the bottom or base of the zone is bounded or blocked, i.e., defined by substantially solid members, such as a generally vertical wall member, which may be part of a bench or cabinet, and a base or deck member. The wall member acts as a screen or shield and prevents ambient (non-conditioned) air from entering the temperature-controlled zone in the same general direction as the conditioned air delivered into the zone by the upper air outlet, such that the wall member defines the suction side of the zone, i.e., the side of the zone in which the central air intake is located. This is critical in order to establish the temperature-controlled zone, such that all air conditioned by the HVAC apparatus is drawn from the temperature-controlled zone.

After the HVAC apparatus has delivered the initial batch of conditioned air into the temperature-controlled zone such that conditioned air is being drawn by the central air intake and recycled to the HVAC apparatus, the air being conditioned by the HVAC apparatus is previously conditioned air retrieved by the central air intake rather than non-conditioned ambient air. In other words, the system operates in a closed loop. Depending on environmental conditions, e.g., in the presence of significant winds, some ambient air may be driven into the temperature-controlled zone to be captured by the central air intake. However, in operation the majority of air retrieved through the central air intake will consist of air that has been previously conditioned by the HVAC apparatus, and all of the air being conditioned by the HVAC apparatus is drawn through by one or more air intake conduits.

Furthermore in this disclosure, the term "deck member" shall be taken to define a member or structure in the nature of a floor having an open area directly above the upper surface of the deck member such that objects or personnel can be freely and directly positioned directly thereon the deck member and removed therefrom. In other words, a "deck member" as claimed herein shall be structured or adapted to directly support tables, chairs, gurneys, etc., and to directly support personnel in a standing position.

Generally, one embodiment comprising a seating system according to principles of the invention provides a central air intake configured to draw a portion of air from the temperature-controlled zone and return this portion of air to the HVAC heating or cooling device. For the purposes of illustration and not limitation, the following discussion regarding some embodiments of the invention may at times be presented in the context of a sideline bench used by a professional sports team, such as a professional football team. However, an ordinary practitioner will understand that the seating system described herein could be adapted for other uses without undue experimentation, such as for firefighters near an emergency location, construction workers in harsh construction environments, or other such scenarios.

The heating or cooling seating system is capable of delivering heated or cooled air into a substantially open zone such that personnel standing or sitting in the zone are cooled or warmed as needed, the defined temperature-controlled zone having a temperature lower than the ambient in hot weather and a temperature higher than the ambient in cold weather. The open zone is not physically fully enclosed by walls, tarps, or the like. In another general embodiment, the seating system comprises a wheeled, transportable system capable of delivering heated or cooled air into a defined, substantially open unbounded zone in a variety of locations or operation sites. This transportable system allows for ease of relocating the seating system, such as to reconfigure the sideline bench area for specific athletic applications, such as reconfiguring a football sideline for subsequent use by a soccer team.

Figure 2:
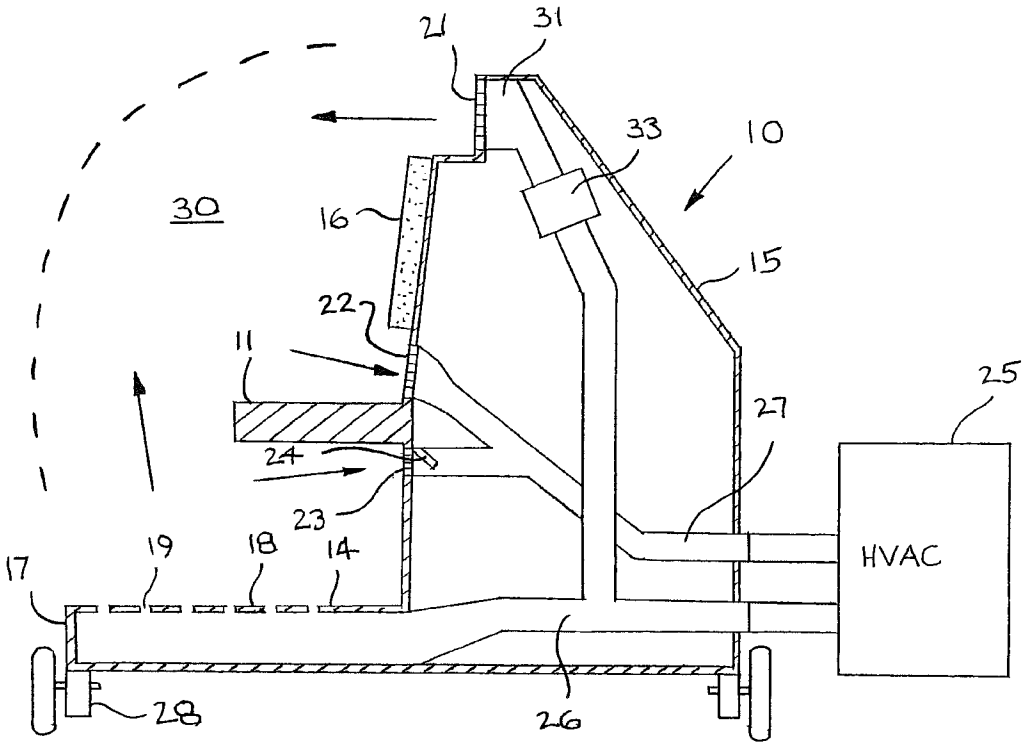
FIG. 2 is a cross sectional view of another embodiment of the seating system showing a second air intake and the transportation means.

Referring to FIGS. 1 and 2, an embodiment of the outdoor heating and cooling system as a seating system is shown as generally comprising a bench device 10 having a seat member 11, a seat back member or wall member 12, and a deck member 14, and a cabinet 15. The system comprises a lower air outlet 20, an upper air outlet 21, a central air intake 22, and a high volume air conditioning (HVAC) apparatus or means 25 for conditioning air by producing heating or cooling temperature charge to air. The air outlets 20/21 and the air intake 22 may each comprise single openings of large and/or longitudinally extended scope, or may each comprise a combination of distinct or separated multiple openings, the openings typically being covered by protective grates or other apertured members. The HVAC apparatus 25 may be one or more units of any known type and may include condensers, chilled water devices, resistance heaters, gas heaters, blowers or like devices well known in the HVAC industry. In embodiments where the HVAC apparatus 25 is placed at a distance from the seating system, the HVAC apparatus 25 should be of sufficient capacity and power to be able to deliver the needed quantity of charged air over a significant distance, such that preferably the HVAC apparatus 25 may be positioned a good distance from the athletic playing field, and preferably under the bleachers or fan seating areas if such are present. Alternatively, the HVAC apparatus 25 could be portable, such that it may be brought near the bench device 10, then removed to storage when not in use. As another embodiment, the HVAC apparatus 25 is a compact unit disposed inside a cabinet 15. For example, in this embodiment the HVAC apparatus 25 may be one or more water to air heat pumps disposed inside the cabinet 15, as described in more detail below.

In a general embodiment of the system, the seat back or wall member 12 generally has a back rest 16. The lower air outlet 20 is positioned on the deck member 14, and the upper air outlet 21 is disposed above the back rest 16. The central air intake 22 is generally located within the seat back 12. As a non-limiting example, the central air intake 22 is located in the seat back 12 between the back rest 16 and the seat member 11 and is disposed interiorly to the ends of the deck member 14 and seat back member 12. The HVAC apparatus 25 is connected to the lower air outlet 20 and the upper air outlet 21 by air delivery conduits 26, and the central air intake 22 is connected to the HVAC apparatus by an air return conduit 27. The air delivery conduits 26 and the air return conduits 27 are enclosed within the cabinet 15, thereby forming a self contained bench device for ease of use and portability.

Figure 3:
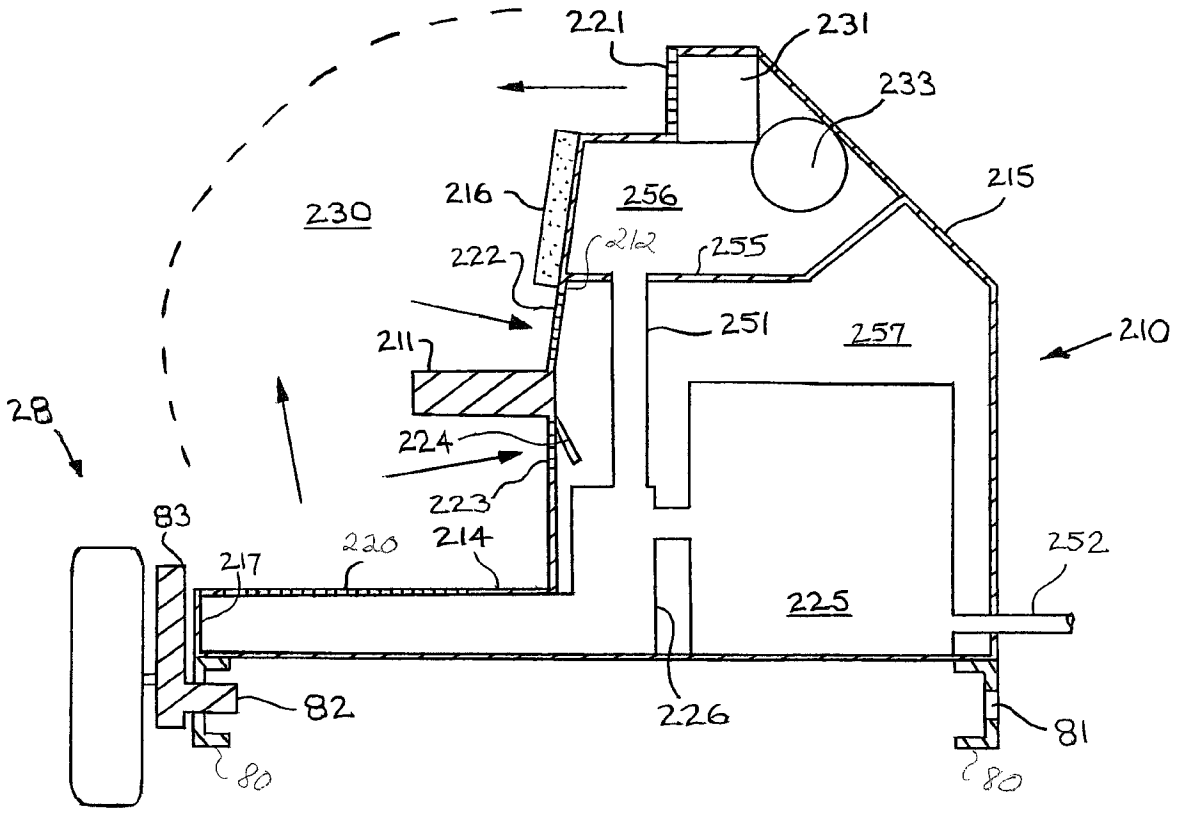
FIG. 3 is a cross sectional view of another embodiment of the seating system in which the HVAC apparatus is disposed inside the cabinet.

In use, the basic embodiment of the seating system permits engagement of the HVAC apparatus 25 to the air delivery conduits 26. The HVAC apparatus 25 forces conditioned air through the air delivery conduits 26 to the lower air outlet 20 and the upper air outlet 21, where the conditioned air is expelled by the seating system to create a temperature-controlled zone 30 that extends approximately four to six feet above the deck member 14. The bold arrows in FIGS. 1-3 show the direction of air flow to and from the temperature-controlled zone 30. The users, such as athletes, can then enter the temperature-controlled zone 30 to raise or lower their body temperature. Once the user enters the zone 30, heat is exchanged between the user and the charged air, depleting the air's temperature charge. A significant portion of air having a depleted charge is then retrieved from the temperature-controlled zone 30 via the central air intake 22 and passed through the air return conduit 27 and returned to the intake of the HVAC apparatus 25. All air conditioned by the HVAC apparatus 25 is provided via the central air intake 22. This air is then reconditioned by the HVAC apparatus 25, re-delivered to the lower air outlet 20 and the upper air outlet 21 via the air delivery conduits 26 and reintroduced into the temperature-controlled zone 30. This return cycle of partially charged air via the central air intake 22 promotes efficiency of the HVAC apparatus 25 because it reduces the temperature range for which the HVAC apparatus 25 must charge its intake air to produce the desired level of conditioning for its output air.

In one embodiment of the seating system, the lower air outlet 20 comprises grating vents 19 in an upper support surface 18 of the deck member 14. In this embodiment, the deck member 14 comprises a housing 17 with sides and a bottom that supports the upper support surface 18, thereby defining an open interior. The interior of the deck member 14 may be provided with baffles, plenums, sectional walls or other means to better distribute the air in an even manner. The upper support surface 18 is constructed such that multiple persons and one or more benches may be readily supported thereon. The lower air outlet 20 takes the form of vents 19 disposed in the upper support surface 18 such that air delivered into the deck member 14 is emitted upwardly from the upper support surface 18. The apertures or slots of the grating vents 19 are sized sufficiently small such that shoe cleats cannot enter the grating vents 19. For example, the grating vents 19 could be holes or slots in a plate member, a grate with intersecting bars, or other possible embodiments.

One embodiment of the upper air outlet 21 comprises a housing 31 having a grate 32 positioned on the bench device 10 above the back rest 16 between the air delivery conduit 26 and the ambient air. In this embodiment, the upper air outlet 21 runs along the full length of the bench device 10. The housing 31 is connected to the air delivery conduit 26, and the housing 31 can further comprise baffles, plenums, sectional walls or other means to better distribute the air in an even manner. As another exemplary option, the air delivery conduit 26 can comprise several conduits that connect along the length of the housing 31 at intervals to assist in even dispersal of conditioned air along the length of the bench device 10. In another embodiment, the upper air outlet 21 further comprises one or more air control means 33 for controlling the flow of air through the air delivery conduit 26 that delivers conditioned air to the upper air outlet 21. The air control means 33 can be one or more booster fans or dampers disposed upstream from the upper air outlet 21 and manipulated to promote or inhibit the flow of air through the air delivery conduits 26 to the upper air outlet 21.

In another embodiment, the seating system further comprises a second air intake 23 disposed in the bench device 10 below the seat member 11 and above the deck member 14, and operably connected to the air return conduits 27. The second air intake 23 may further comprise a damper 24 that is manipulated to control the flow of air through the second air intake 23. For example, in some instances, the conditioned air expelled from the lower air outlet 20 flows uninterrupted past the seat member 11 and into the temperature-controlled zone 30. In these instances the damper 24 remains closed, thereby sealing off the second air intake 23 from receiving air. In other circumstances, the air expelled from the lower air outlet 20 becomes inadvertently trapped between the seat member 11 and the deck member 14. In this scenario, the damper 24 opens, thereby permitting the trapped conditioned air to reenter the system via the second air intake 23, whereby the air is returned to the HVAC apparatus 25 via the return conduits 27. In this manner, the system promotes efficiency by ensuring more of the conditioned air cycles through the temperature-conditioned zone 30.

In another embodiment, shown in FIG. 3, the HVAC apparatus 225 is disposed inside a cabinet 215, with the seat back or wall member 212 defining one wall of the cabinet 215. The outdoor heating and cooling seating system of this embodiment generally comprises a lower air outlet 220, an upper air outlet 221, a central air intake 222, and one or more HVAC apparatus 225 for conditioning air by producing heating or cooling temperature charge to air. The HVAC apparatus 225 is shown as a compact unit disposed inside the cabinet 215. For example, the HVAC apparatus 225 could be one or more water to air heat pumps disposed inside the cabinet 215.

The lower air outlet 220 is positioned on the deck member 214, and the upper air outlet 221 is disposed above the back rest 216. The central air intake 222 is located in the seat back 212 between the back rest 216 and the seat member 211. The HVAC apparatus 225 is connected to the lower air outlet 220 and the upper air outlet 221 by air delivery conduits 226, which take the form of a distribution box running along the longitudinal direction of the seating system inside the cabinet 215. The distribution box 226 is connected to the deck member 214 and emits high volume air via the lower air outlet 220, which comprises grating panels that form the top side of the housing 217 in the deck member 214. The HVAC apparatus 225 delivers air to the upper air outlet 221 via supply conduits 251 intermittently spaced along the length of the distribution box 226. The supply conduits 251 are any duct, baffle, conduit, or other member capable of routing conditioned air from the distribution box 226 to the upper air outlet 221.

In one embodiment, the system further comprises a housing 231 positioned above the back rest 216. In this embodiment, the upper air outlet 221 runs along the full length of the bench device 210. The housing 231 can comprise baffles, plenums, sectional walls or other means to better distribute the output air in an even manner. The upper air outlet 221 can further comprise one or more air control means 233, such as one or more booster fans, to further facilitate air flow from the distribution box 226 through the supply conduits 251, the housing 231, the upper air outlet 221, and into the to the temperature-controlled zone 230. These booster fans can be installed along the length of the upper air outlet 221 at any desired interval.

The central air intake 222 draws a major portion of the partially conditioned air from the temperature-controlled zone 230 back into the cabinet 215 where the partially conditioned air then enters the HVAC apparatus 225 and is reconditioned before being cycled back to the temperature-controlled zone 230 via the distribution box 226, the lower air outlet 220, and the upper air outlet 221. The intermittent spacing of the supply conduits 251 permits the return air to flow between the supply conduits 251 and back to the HVAC apparatus 225. Thus, in this embodiment, there is no need for an air return conduit running directly from the central air intake 222 to the HVAC apparatus 225. In most instances, the intake air simply enters the cabinet 215 through the central air intake 222 and matriculates through the cabinet 225 to the HVAC apparatus 225. The distribution box 226 and the HVAC apparatus 225 are enclosed within the cabinet 215, thereby forming a self contained bench device for ease of use and portability. In this embodiment, the units for the HVAC apparatus 225 are disposed in communication with one or more operation inputs and outputs 252, such as water lines for operation of water to gas heat pumps, or electrical power lines typically available at stadia and athletic facilities.

In one embodiment of the cabinet 215, the cabinet further comprises a dividing panel 255 that separates the interior of the cabinet into an upper compartment 256 and a return air plenum 257. The supply conduits 251 direct conditioned air to the upper compartment 256 where the conditioned air is expelled through the upper air outlet 221, typically with the assistance of booster fans 233. The panel 255 allows the central air intake 222 to operate as a free draw air return, drawing air into the return plenum 257 where the air matriculates back into the HVAC apparatus 225.

In use, the HVAC apparatus 225 forces conditioned air through the distribution box 226 to the lower air outlet 220, and through the supply conduits 251 to the upper air outlet 221, where the conditioned air is expelled to create the temperature-controlled zone 230. The users, such as athletes, can then enter the temperature-controlled zone 230 to raise or lower their body temperature, which depletes the temperature charge of the air, as described above. A portion of air having a depleted charge is then retrieved from the temperature-controlled zone 230 via the central air intake 222 and passed through the interior of the cabinet 215 and returned to the intake of the HVAC apparatus 225. This intake air is then reconditioned by the HVAC apparatus 225 and once again delivered to the lower air outlet 220 and the upper air outlet 221 via the distribution box 226. This return cycle of partially charged air via the central air intake 222 promotes efficiency because it reduces the temperature range for which the HVAC apparatus 225 must charge its intake air to produce the desired level of conditioning for its output air. This increase in efficiency allows the system to operate in a satisfactory manner by using HVAC apparatus 225 of a smaller size, which decreases the footprint of the seating system. This space savings can be an important feature, such as on the crowded sidelines of a professional sports team.

In another embodiment, the seating system further comprises a second air intake 223 disposed in the bench device 210 below the seat member 211 and above the deck member 214. The second air intake 223 further comprises a damper 224 that is manipulated to control the flow of air through the second air intake 223, as described above. Notably, in this embodiment the second air intake 223 does not need to be connected to the HVAC apparatus 225 by an air return conduit, although this could be the case, if desired. In most instances, there is no air return conduit. Instead, the second air intake 223 draws a portion of air from the temperature-controlled zone 230 into the cabinet 215, where this portion of air matriculates to the HVAC apparatus 225 before being recharged and returned to the temperature-controlled zone 230.

Figure 4:
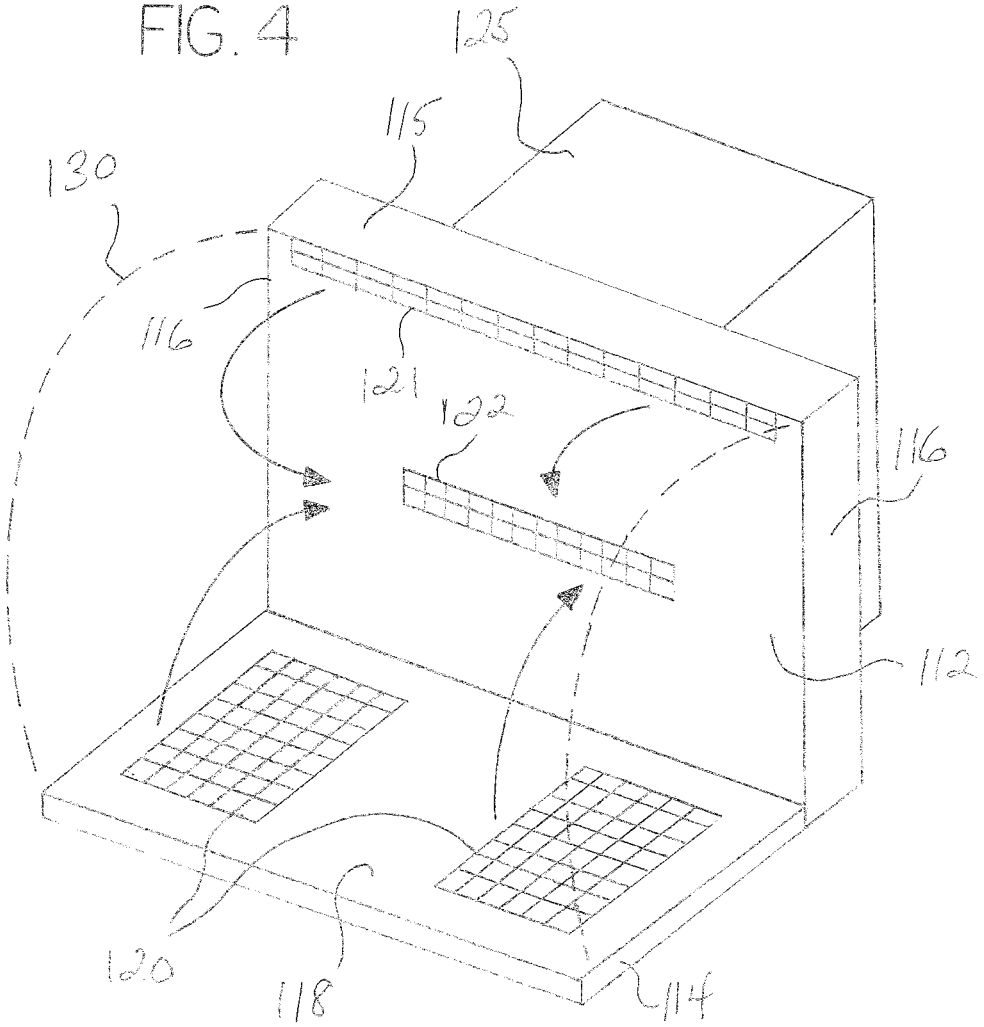
FIG. 4 is a view of another embodiment of the system wherein integral seat members are not present.

In still another embodiment of the invention, the system is a seat-less system, as illustrated in FIG. 4. Operationally and functionally, this embodiment is similar to the embodiments previously described comprising an integral seat member, in that conditioned air is delivered through the first or lower air outlet 120 and the second or upper air outlet 121, and a significant portion of the conditioned air is drawn into the first or central air intake 122 to be returned to the HVAC apparatus or means 125 for recycling, i.e., re-heating or re-cooling as required, before delivery back into the temperature-controlled zone 130 through the first and upper air outlets 120/121.

This embodiment of the temperature-controlled zone outdoor heating or cooling system comprises in general a deck member 114 with an upper support surface 118 structured and adapted to support standing personnel, portable chairs, portable benches, operating gurneys, etc. thereon, and a wall member 112, the wall member 112 being generally vertically oriented. The wall member 112 may comprise a thin screen, a thicker solid or hollow wall structure, a portion of a cabinet 115 defining a larger interior space, etc., provided the wall member 112 is structured so as to block ambient air from entering the rear of the temperature-controlled zone 130. The deck member 114 extends forward from the wall member 112. Dimensions of the system may vary. For example, for a system intended to provide a temperature-controlled zone of conditioned air to standing adult personnel, the height of the wall member 112, or at least the height of the upper air outlet 121, should be at least six feet, whereby the expelled air passes over or against the heads of the personnel using the system.

Air flow in the system is controlled by a combination of elements comprising a lower air outlet 120, an upper air outlet 121, a central air intake 122 disposed within the interior of the temperature-controlled zone 130, and a high volume air conditioning (HVAC) means or apparatus 125 for conditioning air by producing heating or cooling temperature change to air. The lower air outlet 120, upper air outlet 121 and central air intake 122 may each comprise single openings of large and/or longitudinally extended scope, or may each comprise a combination of distinct multiple openings. The lower air outlet 120 is preferably disposed in the deck member 114 whereby conditioned or treated air is expelled upwardly from the deck member 114. The upper air outlet 121 is disposed at, adjacent or near the top of the wall member 112 whereby conditioned or treated air is expelled generally horizontally or downwardly across or toward the deck member 114. The central air intake 122, and any additional centralized air intakes if present, is positioned in the wall member 112 at a height above the deck member 114 and below the top of the wall member 112 and, most importantly, at a height and location below the upper air outlet 121, and is also positioned interiorly relative to the ends 116 of the wall member 112. In this manner, conditioned air expelled from the first and upper air outlets 120/121 is drawn into the central air intake 122 and recycled through the HVAC apparatus 125 prior to reentry into the substantially open, temperature-controlled zone 130. The central and interior location of the central air intake 122 means that all air delivered to the HVAC apparatus 130 is drawn from the temperature-controlled zone 130 such that the majority of air drawn into the central air intake 122 is previously conditioned air that has been expelled from the first and upper air outlets 120/121. The suction of air into the centrally or interiorly located central air intake 122 creates and defines the temperature-controlled zone 130, since absent this element and functionality the conditioned air expelled by the first and upper air outlets 120/121 would simply continue away from the system into the ambient. This would then mean the HVAC apparatus 125 would be continually conditioning 100% ambient air drawn externally. By recycling a majority of the conditioned air from the temperature-controlled zone 135 through the HVAC apparatus 125 and back into the temperature-controlled zone 135, the conditioning cost is greatly reduced, since the recycled air requires less energy to heat or cool than the ambient air. For example, with ambient air temperature of 90 degrees, the HVAC apparatus 125 may be operated to reduce the temperature of the air delivered into the temperature-controlled zone to 75 degrees. Because of heat transfer the temperature of this conditioned air will elevate to say 80 degrees within the temperature-controlled zone. At start up the HVAC apparatus 125 conditions ambient air drawn through the central air intake 122 from 90 degrees to 75 degrees. Once cycling of the 80 degree air from the temperature-controlled zone 130 to the HVAC apparatus 125 begins, significantly less energy is required to reduce the temperature from 80 degrees to 75 degrees, which results in significant cost savings and reduced stress on the HVAC apparatus 125 over time.

The combination of the deck member 114 and the wall member 112 form a generally L-shaped construct, whereby the generally open, temperature-controlled zone 130 is open on the front, top and ends. This configuration allows unimpeded access to personnel, equipment, gurneys, etc. onto the deck member 114 from the front and ends.

FIG. 4 illustrates the HVAC apparatus 125 as being positioned adjacent to the rear of the cabinet 115, but it is to be understood that the HVAC apparatus 125 may be separated from the wall member 112 and/or cabinet 115, in the same manner as the embodiment illustrated in FIG. 1 or 2, or may be positioned internally to the cabinet 115, in the same manner as the embodiment illustrated in FIG. 3. Likewise, the elements for moving the air, i.e., the conduits, ducts, chambers, etc. may be constructed as described above relative to the various embodiments illustrated in FIGS. 1, 2 and 3. In other words, the air transport structures shown in FIGS. 1, 2 and 3 for moving the air from the central air intake 122 to the HVAC apparatus 125 and then to the air outlets 120/121 are suitable examples of elements useful for the embodiment illustrated by FIG. 4.

In another embodiment of the system, shown in FIG. 3, the bench member 10 further comprises transportation means 28 for transporting the system, such as a motorized vehicle or wheeled trailer, such that the system can be taken to any outdoor location where a temperature-controlled zone 30 is desired. For example, the transportation means 28 could comprise a base frame 80 operably connected to the bottom of the bench member 10 and wheels operably connected to the base frame 80. In one embodiment, the transportation means 28 comprises a base frame 80 of structural members having a web, wherein the webs of the structural members comprise receiving holes 81 for receiving an insert member 82 of a wheel assembly. The wheel assembly comprises a jack 83 for raising or lowering the seating system via the base frame 80. Other portions of the base frame 80 can comprise additional receiving holes 81 for receiving an insert member 82 of a trailer hitch, swivel wheel, the arms of a forklift or other such devices used to maneuver the seating system.

For example, the seating system has a longitudinal direction along the length of the seat member 11, and a transverse direction across the seat member 11. The longitudinal members of the base frame 80 comprises receiving holes 81 for receiving the insert members 82 of a wheel assembly and other receiving holes 81 for receiving the arms of a forklift. The transverse member of the base frame 80 comprises a receiving hole 81 for receiving the insert member 82 of a trailer hitch. Thus, the seating system can be attached to the trailer hitch of a tractor or lifted by a forklift and placed on a flat bed truck for transport.

In another embodiment, the bench device 10 is fitted with a canopy attached to a frame extending from the top of the bench device 10. The canopy is configured to overhang the seat member 11 such that the canopy protects persons from precipitation or direct sunlight when the person is seated on the seat member 11.

In any of the foregoing embodiments, the system can further comprise a control means disposed on the exterior of the cabinet. The control means is any means for controlling operation of the heating, cooling, and operation of the system. For example, the control means could be a control panel having operation controls such as on/off, heating/cooling, auto, fan only, high/medium/low, and other modes of operation as desired. In addition, the cabinet in any embodiment can be fitted with any number or configuration of access panels to access the internal components of the system.

The foregoing embodiments are merely representative of the outdoor heating and cooling system and not meant for limitation of the invention. For example, one having ordinary skill in the art would understand that many components described herein can be customized for specific applications by an ordinary practitioner. Consequently, it is understood that equivalents and substitutions for certain elements and components set forth above are part of the invention, and therefore the true scope and definition of the invention is to be as set forth in the following claims.

We claim:

1. An outdoor heating and cooling system creating an open temperature-controlled zone comprising:

an air conditioning apparatus producing conditioned air;

a wall member;

a deck member extending from said wall member, said deck member adapted to support personnel on said deck member;

a lower air outlet, an upper air outlet and a central air intake disposed between said lower and upper air outlets; said central air intake being below said upper air outlet and above said lower air outlet; said lower air outlet, said upper air outlet and said central air intake being in communication with said air conditioning apparatus;

wherein said air conditioning apparatus delivers conditioned air to said upper and lower air outlets and said conditioned air is expelled from said upper and lower air outlets;

wherein the combination of said deck member and said wall member define an open front, ends and top, and wherein said conditioned air expelled from said lower and upper air outlets is drawn through said central air intake and returned to said air conditioning apparatus, reconditioned by said air conditioning apparatus, and redelivered to and expelled from said lower air outlet and said upper air outlet, such that an open temperature-controlled zone of said conditioned air is defined.

2. The system of claim 1, wherein said lower air outlet is disposed in said deck member and said upper air outlet is disposed in said wall member.

3. The system of claim 2, said wall member having a top and wherein said upper air outlet is disposed near said top of said wall member.

4. The system of claim 2, wherein said lower air outlet expels said conditioned air in an upward direction through said deck member and said upper air outlet expels said conditioned air in a forward direction over said deck member.

5. The system of claim 1, wherein said deck member comprises an upper support surface adapted to support personnel standing on said deck member.

6. The system of claim 5, wherein said lower air outlet expels said conditioned air in an upward direction through said upper support surface of said deck member and said upper air outlet expels said conditioned air in a forward direction over said deck member.

7. An outdoor heating and cooling system creating an open temperature-controlled zone comprising:

an air conditioning apparatus producing conditioned air;

a wall member having ends and a top;

a deck member extending forward from said wall, said deck member adapted to support personnel on said deck member;

a lower air outlet disposed in said deck member receiving said conditioned air from said air conditioning apparatus and expelling said conditioned air upwardly through said deck member, an upper air outlet disposed in said wall near said top receiving said conditioned air from said air conditioning apparatus and expelling said conditioned air in a forward direction across said deck member, and a central air intake disposed in said wall between said lower and upper air outlets, below said upper air outlet, above said lower air outlet, and facing said deck member; said lower air outlet, said upper air outlet and said central air intake being in fluid communication with said air conditioning apparatus; and wherein said conditioned air expelled from said lower and upper air outlets is drawn through said central air intake and returned to said air conditioning apparatus, reconditioned by said air conditioning apparatus, and redelivered to and expelled from said lower air outlet and said upper air outlet, such that an open temperature-controlled zone of said conditioned air is defined.

8. The system of claim 7, said deck member further comprising an upper support surface, and wherein said lower air outlet expels said conditioned air through said upper support surface.

9. The system of claim 7, wherein the combination of said deck member and said wall member define an L-shaped construct having an open front, open ends and an open top.

10. The system of claim 7, further comprising more than one said lower air outlet, more than one said upper air outlet, and more than one said central air intake.

11. A method of heating and cooling an unbounded temperature-controlled zone for personnel comprising the steps of:

providing a heating and cooling system comprising an air conditioning apparatus producing conditioned air; a wall member having ends and a top; a deck member extending forward from said wall, said deck member adapted to support personnel on said deck member; a lower air outlet disposed in said deck member and adapted to expel said conditioned air upwardly through said deck member, an upper air outlet disposed in said wall near said top and adapted to expel said conditioned air in a forward direction across said deck member, and a central air intake disposed in said wall between said lower and upper air outlets, below said upper air outlet, above said lower air outlet, and facing said deck member; said lower air outlet, said upper air outlet and said central air intake being in fluid communication with said air conditioning apparatus;

producing and delivering conditioned air to said upper and lower air outlets;

expelling said conditioned air through said upper and lower air outlets;

retrieving through said central air intake a portion of said conditioned air expelled from said upper and lower air outlets;

returning said portion of said conditioned air to said air conditioning apparatus; and reconditioning said portion of said conditioned air retrieved through said central air intake, delivering said reconditioned portion of said conditioned air to said upper and lower air outlets, and expelling said reconditioned portion of said conditioned air through said upper and lower air outlets.

* * * * *